US006322077B1

(12) United States Patent
Braunlich et al.

(10) Patent No.: US 6,322,077 B1
(45) Date of Patent: Nov. 27, 2001

(54) METHOD OF DEPLOYING A CHARACTER IN A CARD GAME

(75) Inventors: Thomas Braunlich; Roland Tesh, both of Portsmouth, VA (US)

(73) Assignee: Decipher, Inc., Norwalk, VA (US)

( * ) Notice: Subject to any disclaimer, the term of this patent is extended or adjusted under 35 U.S.C. 154(b) by 0 days.

(21) Appl. No.: 09/526,568

(22) Filed: Mar. 16, 2000

(51) Int. Cl.[7] ..... A63F 1/00
(52) U.S. Cl. ..... 273/292; 273/308; 463/11
(58) Field of Search ..... 273/292, 308, 273/459, 139, 306, 303, 297; 434/219, 1, 11

(56) References Cited

U.S. PATENT DOCUMENTS

| | | | | |
|---|---|---|---|---|
| 4,979,750 | | 12/1990 | Endrody . | |
| 5,112,059 | | 5/1992 | Mundle et al. . | |
| 5,145,173 | | 9/1992 | Crowder . | |
| 5,201,525 | | 4/1993 | Castro . | |
| 5,213,334 | | 5/1993 | Yih . | |
| 5,360,217 | | 11/1994 | Taylor . | |
| 5,431,399 | * | 7/1995 | Kelley | 273/149 P |
| 5,435,568 | * | 7/1995 | Black | 273/303 |
| 5,520,985 | | 5/1996 | Helicher . | |
| 5,662,332 | | 9/1997 | Garfield . | |
| 5,689,561 | | 11/1997 | Pace . | |
| 5,788,283 | | 8/1998 | Adler . | |
| 5,951,013 | * | 9/1999 | Campanella | 273/308 |
| 6,254,099 | * | 7/2001 | Pederson | 273/292 |

OTHER PUBLICATIONS

Gibson, "Hoyle's Modern Encyclopeida of Card Games", 1974, Dolphin Books, p. 106.*

* cited by examiner

*Primary Examiner*—Raleigh W. Chiu
(74) *Attorney, Agent, or Firm*—McGuireWoods LLP

(57) ABSTRACT

The method of the invention provides a process for a player to deploy cards in a card game. In particular, the invention provides a method for controlling the deployment of cards. In accordance with one embodiment of the method of the invention, character cards are divided into two groups. One group of character cards includes all the common cards. The common cards represent characters that there are "lots of" in a universe. A second group of character cards includes all the unique character cards. A unique character card may be stackable. A unique character card that is stackable indicates that multiple copies of that unique character card may be used in a particular fight, mission, location or any other event, depending on the particular card game. Alternatively, the common character cards may be stackable. Further, all cards in a playing deck of cards may be stackable, as is desirable, to control the use or deployment of the cards.

22 Claims, 9 Drawing Sheets

METHOD OF DEPLOYING A CHARACTER IN A CARD GAME

BACKGROUND OF THE INVENTION

1. Field of the Invention

The present invention relates broadly to a method for controlling the use or deployment of character cards from a deck of playing cards used in a card game.

2. Background of the Invention

Card games have been played and enjoyed by many throughout history. Both adults and children play card games for a variety of reasons including pure enjoyment and entertainment, for the thrill of competition, or to develop mental thought processes.

There is a wide variety of known card games. Illustratively, a particular type of card game is a collectible or trading card game. Collectible card games utilize cards from a person's collection of cards. In contrast to a traditional fifty-two card deck, for example, a person is required to build their own deck in a collectible card game. That is, a person collects cards that are then added into their own personal deck of cards.

For example, a person may obtain the collectible cards through a period of time by trading cards or purchasing the cards. These collectible cards may be packaged and sold alone. Alternatively, the collectible cards may be included as a promotion in a product, such as cereal. Further, the collectible cards may be distributed by store owners, vendors or other sellers.

SUMMARY OF THE INVENTION

This invention provides a method for controlling deployment of cards in a card game. In particular, the invention provides a method for controlling the deployment of character cards. It should be appreciated that as used herein, a "character card" may be characterized as a card displaying a "character" including any of a celebrity, superhero, villain, or any other fictitious or nonfictitious personality of interest. However, it should be appreciated that "character" as used herein does not necessarily mean a "personality." Rather, the "character" on a particular card may include a mode of transportation such as a space ship, a piece of artillery such as a tank, a shelter such as a protective bunker, or any other thing limited only by one's imagination. Accordingly, a "character" may simply be interpreted as a particular type of card.

In accordance with the method of the invention, character cards are divided into two groups. One group of character cards includes all the "common cards." The common cards represent characters that there are "lots of" in a universe, for example. That is, there are many soldiers, for example, such that each soldier card would be considered a common character card. However, the second group of character cards includes all the unique character cards. If a character card is unique, this indicates that there is only one of the character shown on the card in the universe, for example.

In accordance with one embodiment of the invention, the character card has a mass, i.e., there is a mass of that particular character, indicator. The mass indicator represents whether a character is common. As a result, a player may have as many copies of the character cards, which have the mass indicator as is desired. A player may even have different copies of the same character card which include the mass indicator on different planets. Each copy of the card represents a different individual character. However, as noted above, some character cards do not have a mass indicator and are deemed a unique character card in accordance with the method of the invention.

In accordance with the method of the invention, unique character cards may or may not be "stackable." To explain, select cards without the mass indicator symbol represent people and things, for example, that there is only one in the universe. Naturally, each of these characters can only be in one place at one time. For example, a unique character might be the "Master Bargainer." Accordingly, if there is only one Master Bargainer and that character is stranded on earth, then a further Master Bargainer cannot be deployed to a different planet.

However, even though these unique characters are limited to one planet at a time, there is a way, in accordance with the invention, that a player may use extra copies of these unique character cards in play. In accordance with one embodiment, each unique character card includes a stacking indicator. The stacking indicator provides an indication whether two or more unique character cards may be stacked upon one another, i.e., used in fight together, for example. The stacking indicator may include stacked icons of the particular unique character, which indicate that the unique character is "stackable." This designation indicates that a player may build a pile of unique character cards to make the unique character stronger in battle.

For purposes of illustration, the unique character card may be the "Master Bargainer," noted above. When a player possesses a Master Bargainer card and wishes to play that card in a fight on a current planet, a second Master Bargainer card in the player's hand may also be used if the card is stackable. That is, if at least one of the Master Bargainer cards in the player's hand includes indicia that that Master Bargainer card is stackable, then, the player may deploy the second Master Bargainer to the stack of fighting cards.

As a result, two Master Bargainers are disposed in a particular "stack" for a fight. Hence the term that the cards are stackable. In accordance with the play of the invention, this deployment does not mean that there are two Master Bargainers in the universe. Instead the deployment means that the Master Bargainer can now fight twice in each battle because the Master Bargainer will come up twice in the battle plan.

For example, the first Master Bargainer may come up in a battle plan and defeat an opposing character. Then, the second Master Bargainer card takes on the next challenger. This represents how a character in a movie, for example, takes on several opponents during the same battle. The Master Bargainer swings his sword at a first character and then immediately moves to fight another character all in a blur. Accordingly, stackable characters allow a player to simulate this real life aspect of the fight.

Accordingly, the method and game of the invention provide an enhanced methodology by which unique character cards, in contrast to common character cards, may be deployed. That is, the method of the invention provides a process to control multiple deployment of unique character cards.

The stacking indicator on the unique character card, which indicate whether a particular card is stackable, may be any appropriate symbol, indicia or icon, for example. As described below, an illustrative stacking indicator includes multiple icons, of the particular unique character, stacked upon each other. However, it should be appreciated that any appropriate symbol or set of symbols may be utilized to indicate the stackability of the cards.

Further, the method of the invention is described below in conjunction with a particular card game utilizing collectible playing cards. However, it should be appreciated that the method of the invention may be utilized in any of a wide variety of card games and is not limited to the particular implementation that is described below. For example, the method of the invention may be utilized in conjunction with a static deck of cards in which the composition of cards does not change.

It should be appreciated that the card does not necessarily have to include a symbol or other indicia to indicate the class of the card. Alternatively, a list may be provided. That is, the list may provide information regarding whether a particular card is stackable. Accordingly, a card player looking at a particular card alone would not be able to ascertain whether a particular card is stackable. However, the list of classes would provide a key or legend, for example, such that the card player could determine whether a particular card is stackable.

In accordance with an embodiment of the invention, each of the cards is a physical object. However, as described below, the method of the invention may be implemented in an electronic card game using a suitable electronic operating system. The electronic operating system may be a computer system, for example.

The method of the invention may be used in conjunction with a trading card or a playing card. A trading card may be characterized as a card intended primarily for trading amongst persons. In contrast, a playing card may be characterized as a card intended primarily for playing. Illustratively, a trading card may be more oriented towards specific celebrities or super heroes, for example.

It should be appreciated that the invention may be used in conjunction with a variety of other card game features, such as those described in U.S. patent application Ser. No. 09/526,917, which is incorporated herein by reference in its entirety.

The method of the invention is described herein with reference to the stackability of unique character cards. However, it should be appreciated that the invention is not limited to such implementation. For example, the common character cards may be stackable. Further, it is within the scope of the invention that all cards in a playing deck of cards may be stackable as is desirable. Further, the stacking method of the invention may be used in a card game in which there are not particular groupings of cards. Accordingly, the stacking method of the invention may be used in a variety of ways with a variety of card games.

As described herein, the stacking method of the invention is described in the context of a "fight." However, it should be appreciated that the stacking method of the invention may be used in a wide variety of contexts other than a fight such as a mission, a location, or any other event or occurrence.

The invention provides a method of play in a card game comprising the steps of determining whether a first card of a type is a stackable card; and combining, if the first card is a stackable card, the first card with at least one other card, the at least one other card of the same type as the first card.

Further, the invention provides a method of play in a card game comprising the steps of determining whether a first character card, that displays a character, is a common character card or a unique character card; determining, if the first character card is a unique character card, whether the first character card is a stackable character card; and combining, if the first character card is a stackable character card, the first character card with at least one other character card, the at least one other character card displaying the same character as the first character card.

The method of the invention further provides various other features. In accordance with one embodiment, the step of determining whether a first character card is a common character card or a unique character card is performed by observing a symbol on the first character card. In accordance with one embodiment, a diamond symbol on the first character card indicates that the first character card is a common character card. For example, stacked representations of the character, on the first character card, may be used to indicate that the first character card is a unique character card.

In accordance with one embodiment, the step of combining the first character card with at least one other character card, the at least one other character card displaying the same character as the first character card, includes using the first character card and the at least one other character card in the same fight. The first character card and the at least one other character card may be used sequentially, without other character card used between, in the same fight. The character card may be a collectible card or a static card, wherein the static card forms a static deck with other static cards, the composition of the static deck remaining constant.

The method as described above may further include the steps of providing a list disclosing whether a character card is a stackable character card; and reviewing the list for a particular character card to determine whether a particular character card is a stackable character card. Each of the character cards may be a physical object. Alternatively, each of the character cards is electronically represented using an electronic operating system, such as a computer system. Each of the cards may be a trading card. The method of the invention may also include determining if the first character card is present at a location different then the location currently in play; and combining the first character card with at least one other character card, only if the first character card is not present at a location different then the location currently in play.

In accordance with an embodiment, the invention provides a set of playing cards for use by a card player, the set comprising common character cards, each of the common character cards representing a common character; unique character cards, each of the unique character cards representing a unique character, each of the unique character cards being identifiable as a stackable character card or a non-stackable character card; and wherein each of the stackable character cards, displaying a specific character, may be used with at least one other stackable character card displaying the same specific character.

Whether the character card is a common character card or a unique character card may be designated by a symbol on the character card. Specifically, the character card may display a diamond if the character card is a common character card; and the character card does not display a diamond if the character card is a unique character card. Further, each of the stackable character cards may be designated by displaying multiple icons of the respective character of the character displayed on the stackable character card.

BRIEF DESCRIPTION OF THE DRAWINGS

These and other aspects of the invention will become apparent from the following descriptions which illustrate exemplary embodiments of the invention when read in conjunction with the accompanying drawings, in which.

DETAILED DESCRIPTION OF THE PREFERRED EMBODIMENTS

Figure 1:
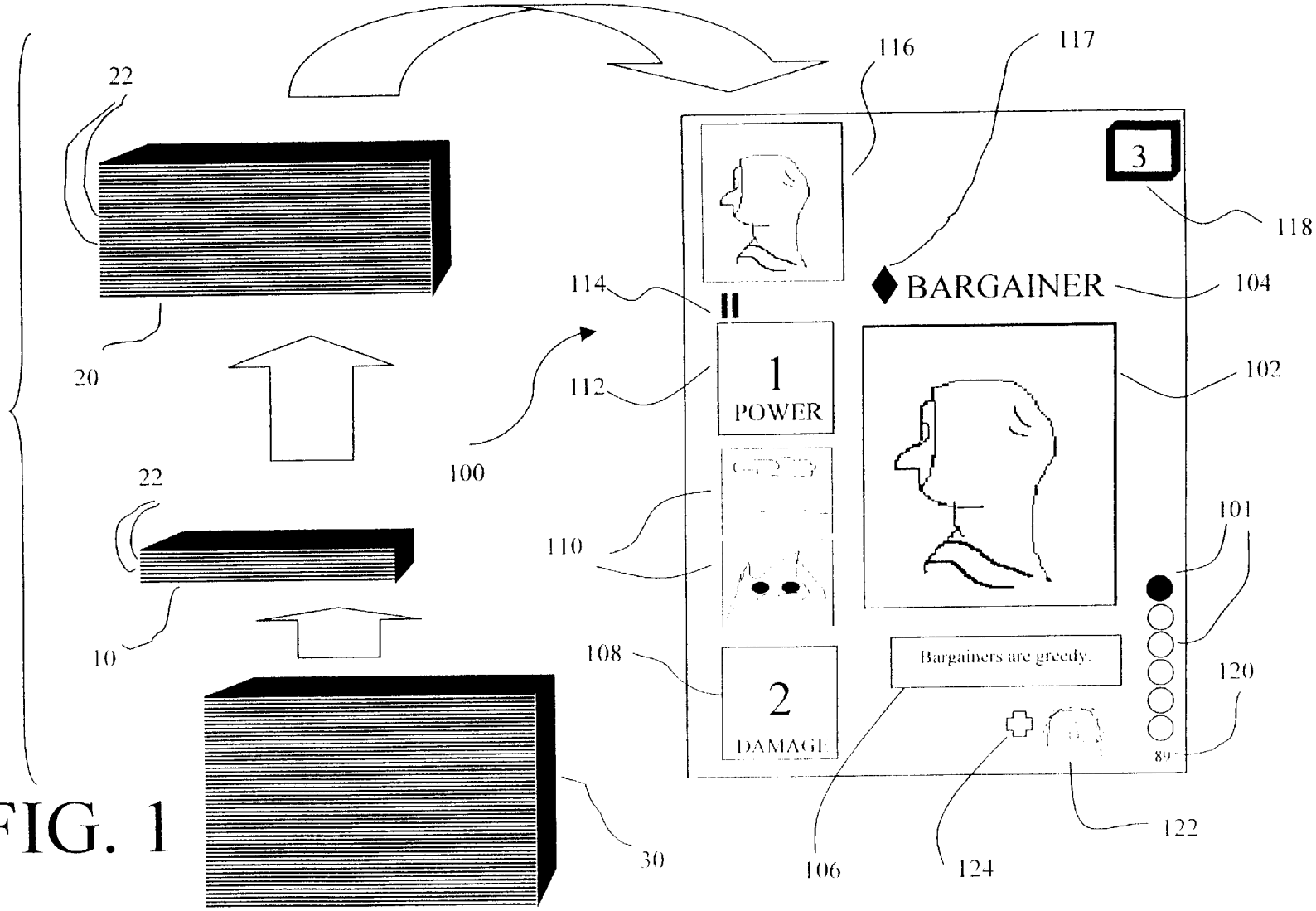
FIG. 1 is a diagram showing a character card in accordance with an embodiment of the invention.

In accordance with the method of the invention, a process is provided to control use of common character cards and unique character cards. FIG. 1 illustrates one embodiment of a card utilizing the method of the invention. Specifically, FIG. 1 shows a collectible card 100. The collectible card 100, as shown in FIG. 1, is a common character card. A unique character card is described below in conjunction with FIG. 7.

As described herein, the method of the invention may be used with any of a variety of cards including collectible cards, or alternatively, static cards in which the number of cards in a card deck does not vary. Further, the method of the invention may be utilized in conjunction with trading cards or playing cards, for example. As described below, the method of the invention is disclosed in conjunction with a set of collectible cards for purposes of illustration.

FIG. 1 shows a collectible card 100 in accordance with an embodiment of the invention. The set of collectible cards may include any of a wide variety of cards limited only to the imagination. For example, the collectible cards may include character cards, weapon cards, location cards, reinforcement cards, and ship cards, for example. FIG. 1 specifically shows the face of a character card 100. The opposite side of the card 100, from that shown in FIG. 1, may include any suitable print. This print might include any logo or possibly wording reflecting the theme of the collectible card game. The cards may be constructed using any well known construction for cards. For example, the cards may be constructed using laminated paper construction.

As shown in FIG. 1, the character card 100 includes a character picture 102 and a character name 104. In this example, the character is a bargainer. Additionally, the character card 100 includes a variety of other indicia used in playing the collectible card game. These indicia are discussed in summary here but will be discussed in detail below in conjunction with other aspects of the collectible card game.

The character card 100 includes deck building dots 101, character picture 102, character name 104, description window 106, damage number 108, bonus power location indicator 110, power number 112, counters 114, stacking indicator 116, mass indicator 117, chance number 118, card number 120, expansion set icon 122, and rarity icon 124.

FIG. 1 also shows a class set 10 often cards 22. In accordance with the method of the invention, the class set 10 is combined with other class sets to form a playing deck 20. The cards 22 in each of the class sets is chosen from the card player's entire collection of cards 30, as shown in FIG. 1. Accordingly, the collection of cards 30 may be characterized as a "reservoir deck" of cards, from which cards may be exchanged with the cards in the playing deck 20.

The deck building dots 101 used to control the composition of a player's deck 20 of cards 22. To explain further, a player may have potentially hundreds of cards 22 in her personal collection of cards 10. The player chooses from the larger collection to generate a class set 10. Each card 22 in the 10 belongs to a particular class of cards. Illustratively, there may be six classes.

The deck building dots 101 indicate which class a particular card is a member. For example, there may be six different colors to indicate the respective class of the card. For example, the top deck building dot 101 may be red. Further, the second to top deck building dot 101 may be orange, and so forth. Thus, the class of the card is shown by which deck building dot is colored, as well as the particular color.

The character card 100 also includes various other indicia. The description window 106 includes printed text revealing some trait of the character, for example. The text in the description window 106 might be for entertainment or educational purposes. The damage number 108 indicates the damage to a player's draw deck, as described further below, if the character card 100 is defeated. The bonus power location indicator 110 controls whether extra bonus points are provided based on the current location at the time the character card 100 is played. The power number 112 indicates the power of the character card 100. The counters 114 are used to control and limit the amount of cards deployed in any given turn.

As shown in FIG. 1, the stacking indicator 116 indicates the manner in which that particular character card 100 may be repeatedly used, i.e., for one of a kind or unique characters, as described above and in further detail below. The mass indicator 117 indicates whether a player may use multiple cards of that particular character. That is, cards which display the mass indicator 117 are not unique, but rather common cards. As a result, there is not a restriction on the manner in which multiple common cards may be used, subject to the other rules of the card game of course.

The chance number 118 is utilized in conjunction with a player deploys a weapon, for example. Additionally, the character card 100 includes other attributes. The card number 120 is a number unique to that particular card 22. The expansion set icon 122 provides information regarding the source of the card 22, i.e., which expansion set the card was originally obtained from. Also, the rarity icon 124 indicates whether that particular card is rare, uncommon, or common relative to other cards in the same expansion set.

Figure 2:
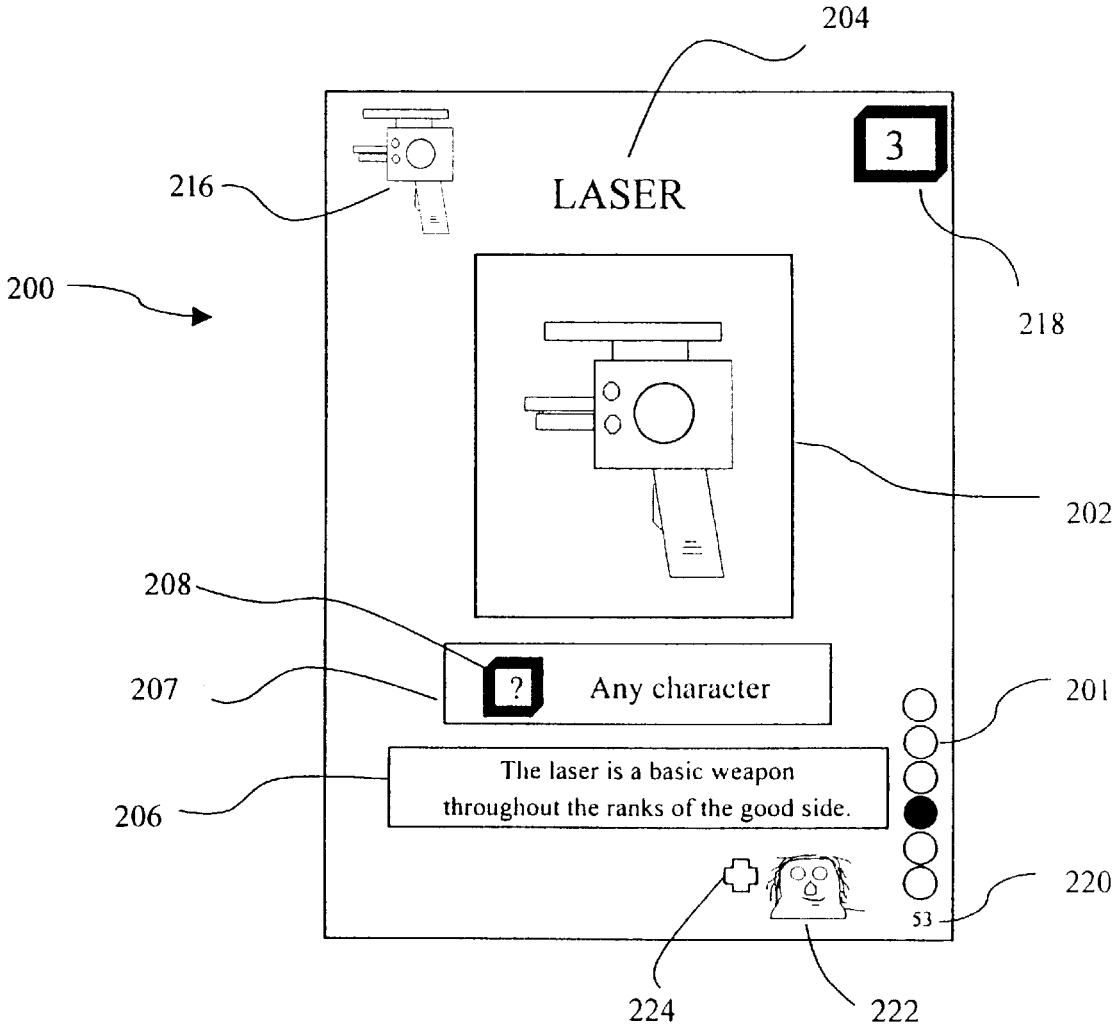
FIG. 2 is a diagram showing a weapon card in accordance with an embodiment of the invention.

As described above, each player may possess a card collection of potentially hundreds of cards. From this card collection, a user forms a card deck 20 containing a plurality of cards 22. The cards 22 may be any of a wide variety of types of cards. In further explanation of the invention, FIG. 2 shows an exemplary weapon card 200. Similar to the character card 100, the weapon card 200 includes deck building dots 201, a weapon picture 202, weapon name 204, a description window 206, a chance block 208, stacking indicator 216 and chance number 218.

Also, the weapon card 200 includes a restriction window 207. The restriction window 207 dictates what character the weapon card 200 may be utilized with. For example, the restriction window 207 as shown in FIG. 2 illustrates that the weapon card 200 may be used with any character. Also, similar to the character card 100, the weapon card 200 includes a card number 220, an expansion set icon 222, and a rarity icon 224.

Figure 3:
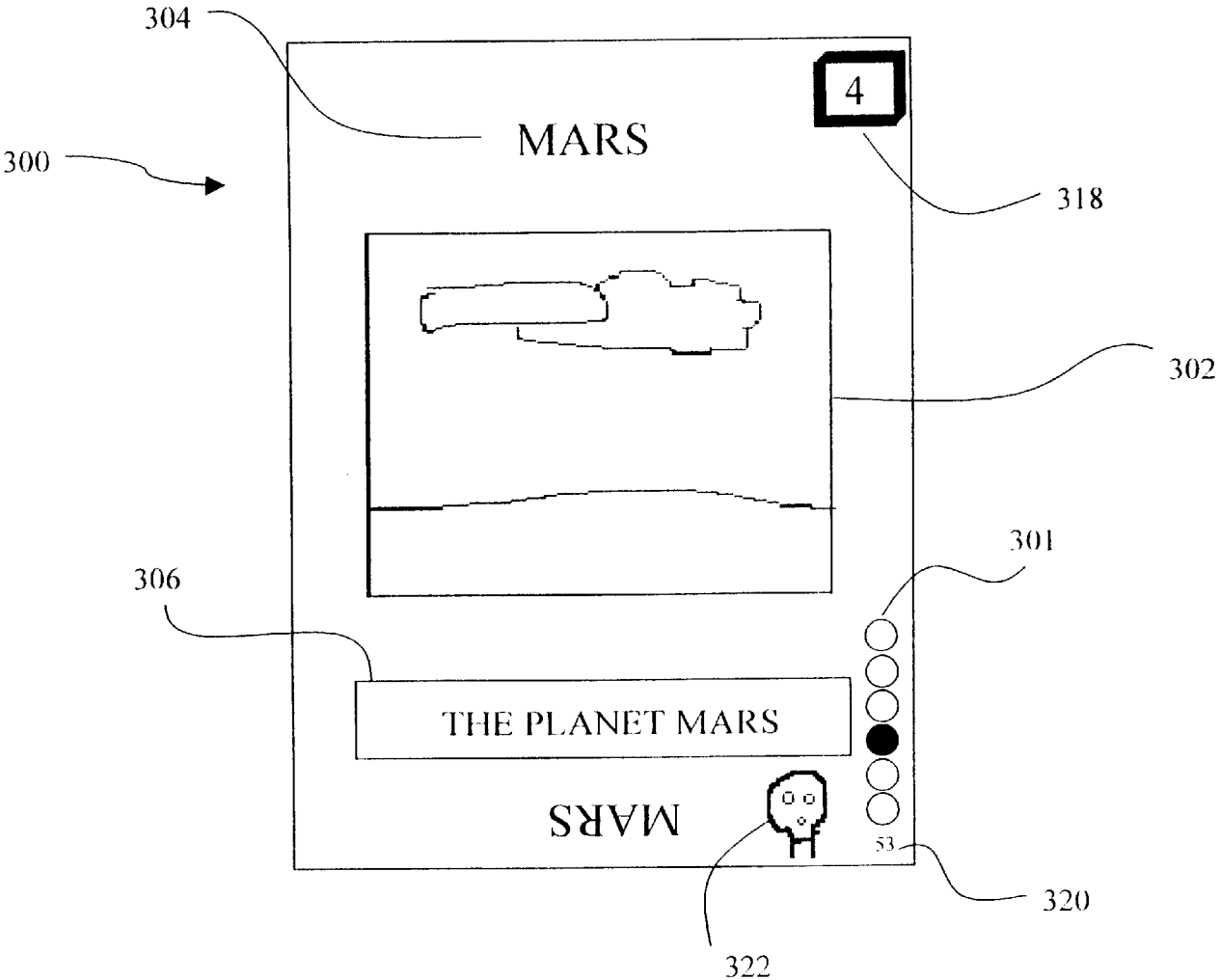
FIG. 3 is a diagram showing a location card in accordance with an embodiment of the invention.

FIG. 3 shows a location card 300 in accordance with an embodiment of the invention. The location card 300, similar to the character card 100 shown in FIG. 1, includes deck building dots 301. The location card 300 also includes a location picture 302, a location name 304, and a description window 306. The location card 300 further includes a chance number 318, a card number 320, and an expansion set icon 322. As shown in FIG. 3, the location card 300 does not include a rarity icon. However, it should be appreciated that this is merely one embodiment of the invention and that the location card 300 could indeed disclose a rarity icon for entertainment or any other desirable purpose.

Figure 4:
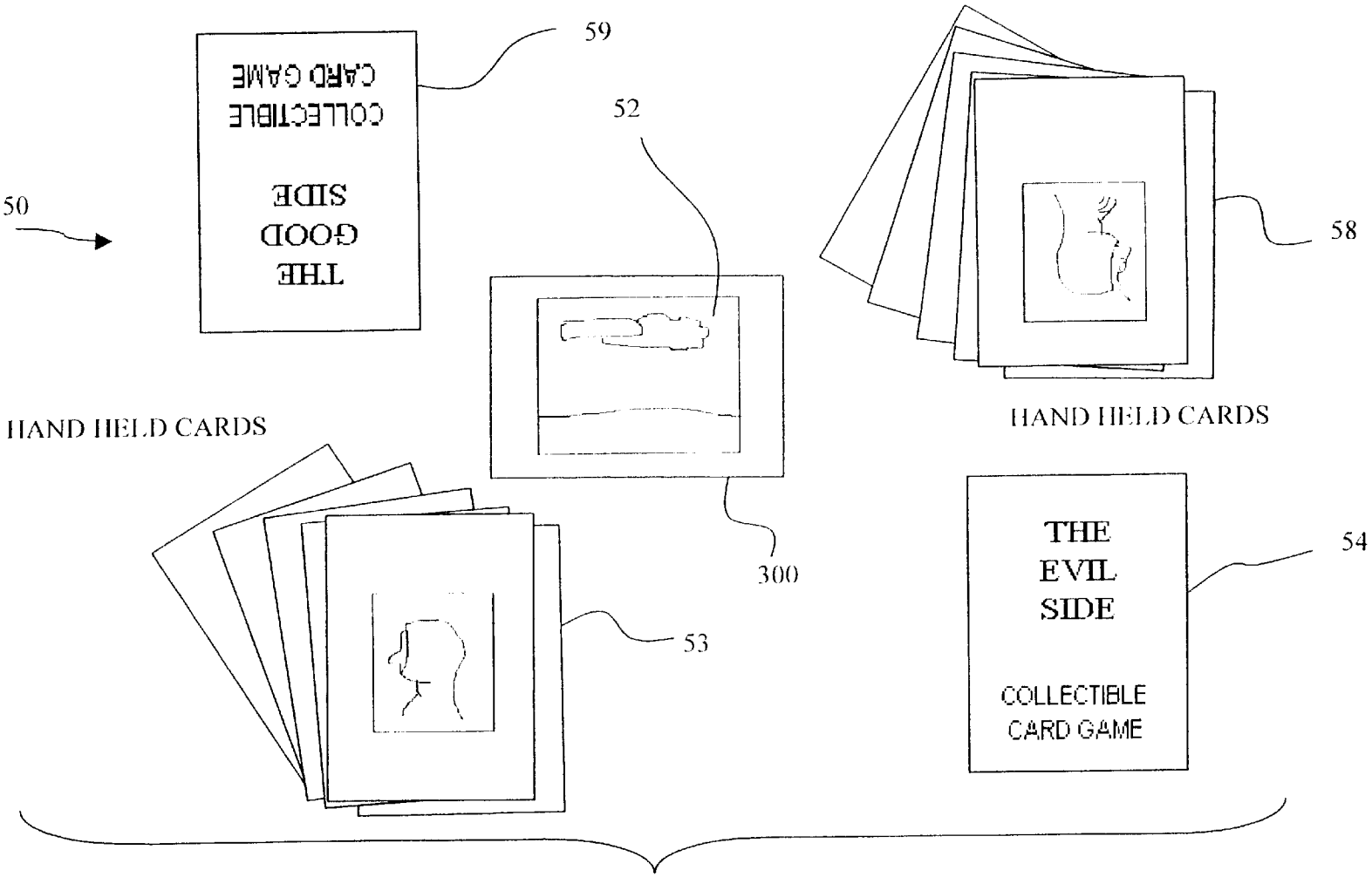
FIG. 4 is a diagram showing the initial set up of cards in accordance with an embodiment of the invention.

FIG. 4 illustrates an initial set up 50 in accordance with the invention. In accordance with one exemplary embodiment, a player has two ways by which to win the game. First, a player may achieve a planet victory. In a planet victory, the player wins if she takes control of the planet. Alternatively, the player may win by a deck victory. In a deck victory, a player wins if the player's opponent runs out of cards before the player does.

FIG. 4 illustrates the initial set up of a card game in accordance with the invention. As shown in FIG. 4, the location card 300 dictates the starting location 52. The card game might be between the evil side and the good side. FIG. 4 shows an evil player's hand 53 and an evil player's draw deck 54. FIG. 4 also shows a good player's hand 58 and a good player's draw deck 59.

To arrive at the set up 50 shown in FIG. 4, either the evil side player or the good side player arbitrarily takes a location card 300 from her deck and places it on the table. This then dictates the first location of the game. Each player then shuffles their remaining cards and puts them face down on the table to make each respective player's draw deck 54, 59. Both the evil player and the good player draws six cards from the top of his deck to make a starting "hand." Each player should not let the opponent see which cards they have in their respective hands. Accordingly, these described steps will result in the initial set up 50 shown in FIG. 4.

Then, for example, the evil player takes the first turn of the game. Each player's turn has potentially three steps in a specified order. The three steps include (1) deploy step, (2) battle step, and (3) an even up step. In the deploy step, each player plays their character, weapon and location cards, for example. In the battle step, a player may attack their opponent's characters on the current location. Then, in the even up step, a player may draw or discard until that player has six cards in their hand.

It should be appreciated that a player does not have to perform the deploy step or the battle step if they choose not to. However, the player must always perform the even up step. Once the evil player evens up, for example, the evil player's turn is over and the good player then takes her turn. Hereinafter, the three steps will be described in further detail.

In the deploy step, each player deploys cards in anticipation of future battles with their opponent. As described above, the character and weapon cards have a small picture of a character or weapon in the top left hand corner of the card, i.e., the stacking indicator 116 as shown in FIG. 1. Under the small pictures are counters 114. The counters 114 indicate how much it costs for a player to put that card 22 into play. For example, in each turn a player may deploy six counters, i.e., the player may put up to six counters into play.

Illustratively, in accordance with the rules of the deploy step, a player may put out as many characters or weapons as that player wants, as long as the cards in total do not have more than six counters. On the player's next turn, that player can put out an additional six counters, and so on. It should be appreciated that the number of counters on each card is varied based on various attributes of any particular card. For example, a very powerful card may alone have six counters. Accordingly, a player would only be able to deploy that one card in a given turn, since that one card in and of itself attains the maximum six counters. Once a player decides which cards they will deploy, that player places each deployed card next to each other on that player's side so that both players can see how many cards were deployed.

Figure 5:
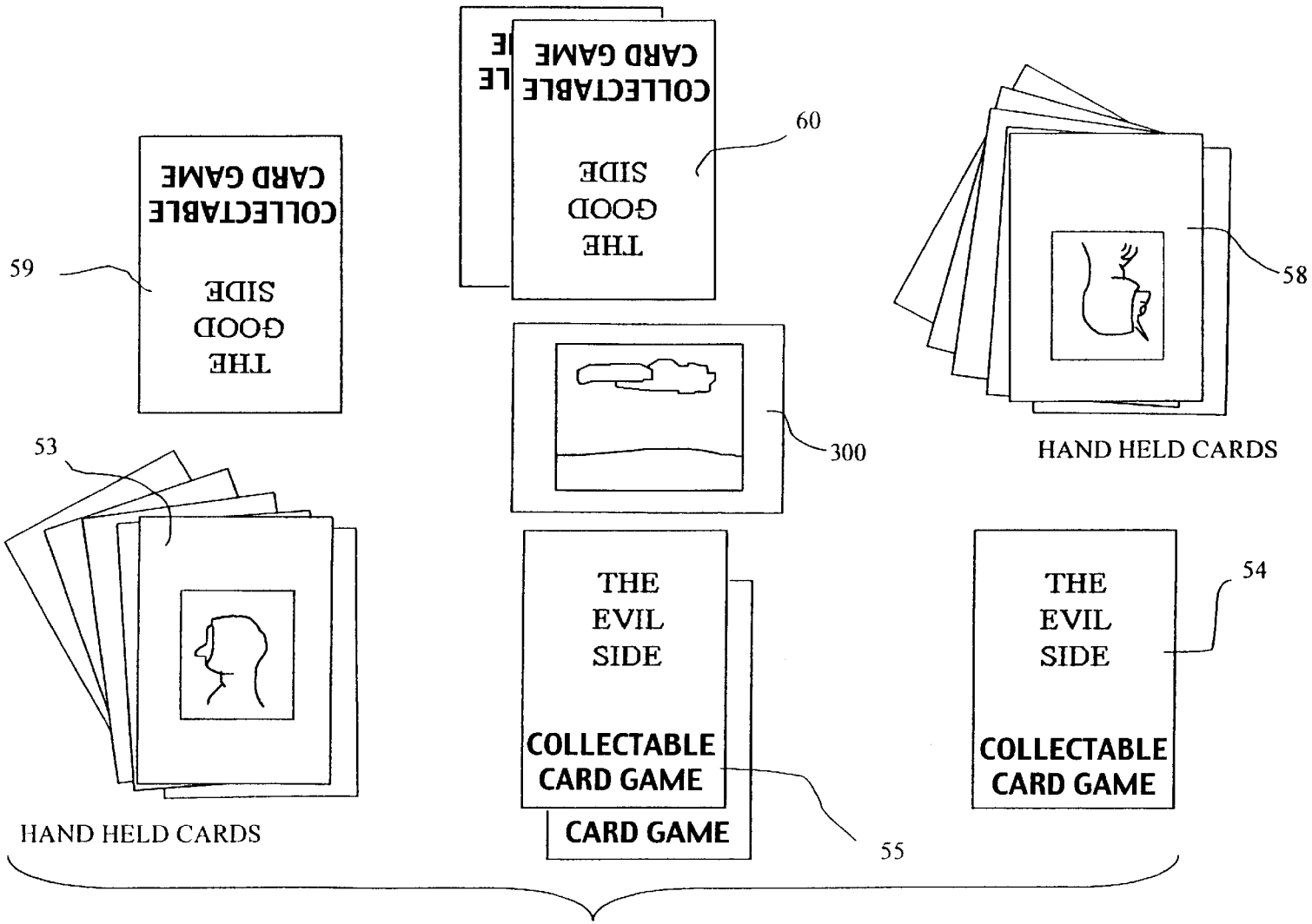
FIG. 5 is a diagram showing the set up of cards subsequent to each opposing player deploying in accordance with an embodiment of the invention.

In accordance with an embodiment of the invention as further illustrated in FIG. 5, on the player's first turn of the game, the cards that the player deploys must be hidden, i.e., placed face down. Illustratively, the deployed cards 55, for the evil side, are concealed from a player's opponent for one turn. At the start of the player's second turn of the game, that player turns those hidden deployed cards 55 face up, as well as all the cards that player deploys thereafter at that particular location 52.

The opponent performs the same step. Specifically, the opponent deploys her deployed cards 60 face down on his first turn, and reveals the cards at the start of the opponent's second turn. As a result, both players are provided two turns to deploy cards before any battles can break out.

In accordance with an embodiment of the invention, the "location" may be changed. For example, with the arrangement shown in FIGS. 4 and 5, the battle location is Mars. However, a player may change the location by using different location cards. In accordance with an embodiment of the invention, some of the characters fight better at certain locations.

When a player wishes to change the location or scene during that player's deploy step, the player simply deploys a different location card from the player's hand. The player places the location card on top of the location card on the table, thus covering that previous location card up. It should be noted that location cards have no counters, so the deployment or placement of the location card does not go against the limit of six. When the player changes the location of a scene on a planet or moves the location to another planet, this effectively represents all of that player and his opponent's characters and weapons moving from the old location to the new location.

In accordance with the invention, battles are fought from time to time. More specifically, on each of the player's turns, that player may declare one battle on Mars, for example, if that player and their opponent both have characters face up at that location. Accordingly, hidden cards cannot do battle. Further, it should be appreciated that a player does not have to declare a battle if that player does not wish to declare battle in any given turn.

If a player chooses to initiate a battle, before the fighting starts, the player temporarily puts their hand face down on the table away from the player's draw deck. The player then picks up all of the characters on Mars that have been deployed. If any weapons have been deployed, the player also picks up those.

Then, the player makes a "battle plan" for the characters they hold in the player's hand. The opponent picks up her own cards and makes her own battle plan at the same time.

Each battle is made up of a series of individual "fights" between two opposing characters. In accordance with an embodiment of the invention, each player must put their cards in the order that that player wishes to fight. This is called a "battle plan." For example, the card located at the top of the battle plan generated by the player, assuming that the cards are face down, is the card that fights first. When the player is finished developing their battle plan, that player closes up the cards into a pile and puts the pile face down on the table. When the opponent also has her battle plan ready and places her cards face down on the table, then it is time to battle.

To initiate the battle, both players turn up the first character in their battle plan, i.e., the one on top of the pile. These two characters fight each other using the "power" they possess. Various attributes of the character card are used to compute the power of that character card. As shown in FIG. 1, each character card 100 includes a power number 112. As shown in FIG. 1, below the power number 112 is the bonus power location indicator 110 that includes two small pictures. Each of the pictures matches a particular location. For example, the upper bonus power location indicator 110 in FIG. 1 shows Mars since it matches with the location card 300 shown in FIG. 3. If the character card 100 has one or more power bonus dots for the location where that character is fighting, the number of dots on that location is added to the character's power. For example, in FIG. 1 the bonus power location indicator 110 includes a picture of Mars above and a picture of earth below. Accordingly, if the current location of play were Earth, then two additional points would be added to the power of one, using the card 100 shown in FIG. 1 as an example.

In accordance with an embodiment of the invention, the fighting characters compare their power number 112, plus any location bonuses, to determine which player wins that particular fight. If a character has more total power, then that character wins the fight. The winning character then stays at Mars, for example. This is represented by the winning player moving over their winning character to make room for the next character in the battle plan to fight.

However, the opponent's character was defeated in the fight. Accordingly, the opponent must place that character face up in a discard pile in some suitable location, i.e., for example, next to the opponent's draw deck. The opponent also suffers an additional penalty for losing that particular fight. Specifically, assuming the opponent lost the fight, then the opponent takes damage to his draw deck for that character's loss.

As shown in FIG. 1, the character card 100 includes a damage number 108. The damage number 108 on the defeated character's card 100 shows how many cards the opponent must discard from the top of his draw deck 58, as shown in FIG. 4, assuming that the opponent was the "good side."

It should be appreciated that both characters may have the same total power in any given fight. If this is the situation, then both characters of both players stay at the location Mars, for example. Accordingly, neither character is defeated and neither player is required to discard any cards from his or her respective draw deck.

After the initial fight is over, then each player turns up their next character from their battle plan. The fight is carried out in the same manner as described above. That is, the character's power number 112, in addition to any location bonuses controlled by the bonus power location indicator 110. The player who loses the fight is required to discard her character and take damage to her draw deck, as described above.

Accordingly, the fight continues on as each player turns up a further character based on their battle plan. As should be appreciated, eventually one player's battle plan runs out of characters. Once this point occurs in the game, if the attacker, i.e., the player who initiated the battle, possesses any "leftover" characters that did not fight, then each of the leftover characters "breaks through the battle line." In other words, the opponent must discard one card from the top of his draw deck for each of the player's "break through" characters.

In accordance with this embodiment of the invention, a player cannot hit their opponent with a "break through" unless that player is the attacker. Thus, this is one advantage of initiating the attack. Once the battle is over, each player returns their remaining character cards, if any, to that player's side of the location card 300. Then each player picks up their respective hand 53, 58.

Subsequently, each player "evens up." The even up step is the last step of each players turn. After a player deploys, or decides not to deploy, and then initiates a battle, or decides not to initiate a battle, then the player always is required to bring their hand back to six cards. This means, if the player holds less than six card, then the player must draw cards from that player's draw deck until the player has six cards in their hand. Alternatively, if the player holds more than six cards, then the player must discard cards from the player's hand until the total held is down to six. Further, before a player evens up, the player should discard any location cards from the player's hand, if the player chooses to do so. However, for strategic reasons the player may choose to retain the location card in their hand.

In addition, the "even up" step may be performed by the player discarding their entire hand and drawing six new cards. This approach may be helpful when the player possesses cards in their hand that the player cannot use presently.

As described above, one manner of winning the game is to "control the planet." At the end of either player's turn, if the player has one or more characters face up on Mars and the opponent has no characters face up, then the player wins control of Mars. However, it should be appreciated that one cannot win control of any planet while the player's opponent has hidden cards.

Further, a player may only take control of a planet at the end of either player's turn. Accordingly, if a player declares a battle and knocks all of the player's opponents characters off a planet during battle, then the player must finish their turn before the player controls the planet.

In accordance with one embodiment of the invention, control of the planet means that that player wins the game. In accordance with an alternative embodiment, there are multiple planets. In this additional embodiment, a player must control two planets to win the game.

Hereinafter, additional aspects of an embodiment of the card game of the invention are described with reference to FIG. 2. As described above, FIG. 2 illustrates a weapon card 200. The weapon card 200 may be used in a player's battle plan. The weapon card 200 may add to the power of a character. If a battle is initiated as described above, then each player picks up all his character cards 100. Also, each player picks up all the weapon cards 200. After a player has placed the characters in the order they desire the characters to fight, then the player chooses whether that player wishes to deploy any weapons with any of the characters in their battle plan. A weapon card 200 is used with a character card 100 by placing the weapon card behind the character card 100, assuming that the cards are facing the player. As a result, when the player places the battle plan stack of cards face down, the weapon card 200 will be pulled before the associated character card 100, thus prompting the player to draw a further card, i.e., a character card. It should be appreciated that a player may use numerous weapons in a battle. However, the player may only use one weapon card in each fight.

When a player turns over a weapon card 200 from their battle plan during a fight, that player immediately recognizes it as a weapon card and as a result immediately turns over the next card, which must be a character. The weapon card 200 will add to the power of the character card 100.

Illustratively, a battle may start and the opponent may turn over a character who has a power of four. Then, the player playing against the opponent turns over a rifle and, since this is not a character, immediately turns over the next card. The next card is necessarily a character card 100, which will be used with the weapon card 200. For example, the character card 100 may have a power of two. Assume the opponent's character card has a power of four. Normally, then, the opponent would defeat the player's card, i.e., four to two. However, since the character card of the player has a rifle, then the player's character card has a chance to win this fight.

As shown in FIG. 2, the weapon card 200 includes a restriction window 207. The restriction window 207 designates whether there are any restrictions with regard to the character that the weapon card 200 may be used with. As shown in FIG. 2, there is no such restriction and the weapon card may be used with any character card 100. The restriction window 207 also includes a chance block 208.

Accordingly, the particular weapon card shown in FIG. 2 may work with any character and adds a random number to the character's power. This random number in affect represents the unpredictable effect of a weapon in battle. For example, a laser may hit its target or it might miss. Alternatively, a tank might help a character out-maneuver the opponent, or it might not.

As shown in FIG. 2, the restriction window 207 includes a chance block 208. The chance block 208 includes a question mark. The question mark indicates that the player draws "destiny" to find out how much power will be added as a result of the weapon.

In accordance with an embodiment of the invention, the player draws destiny by drawing the top card from the player's draw deck. The player then places that card face up on the table. As used herein, the "face" of a card indicates the side of the card as shown in FIG. 1. Alternatively, the back of the card indicates the opposing side of the card which may include any appropriate generic indicia, for example Used in this role, the drawn card is referred to as the "destiny card." As shown in FIGS. 1–3, each card includes a chance number 118, 218, 318. The player reads out loud the chance number 218, for example. That chance number 218 is added to the character's power.

It should be appreciated that it does not matter what kind of card a player draws for destiny. It may be any type of card since all cards have the chance number 218. Further, in the role of the destiny card, no other specifics other than the chance number 218 is considered.

For example, suppose that the chance number 218 on the destiny card possesses a value three. This value of three is added to the player's character power of two, for example, to give that character a total power of five for that particular fight. Assuming that the opponent's character still has a power of four, since the opponent's character had no weapon to use for the destiny draw, the evil player wins this fight.

After the fight, the player places the destiny card in that player's hand. As described above, the player's hand is temporarily setting face-down on the table. As a result, the player simply places the destiny card on top of it. Of course, if the opponent's character is also using a weapon, then both players will be drawing their own destiny cards and reading aloud each destiny card's respective chance number 218. If a character is defeated when using a weapon, then the weapon card is discarded along with the character.

It should be appreciated that there may be too many weapon cards, which have been deployed, for the characters to use them all. Alternatively, there may be weapons which have been deployed that the player does not want to use in the current battle for some strategic reason. Since there is no character to come up "after" these weapon cards, the weapon cards will not be used in the battle. Further, the weapons cards will not be lost if any of the player's characters are defeated.

Figure 6:
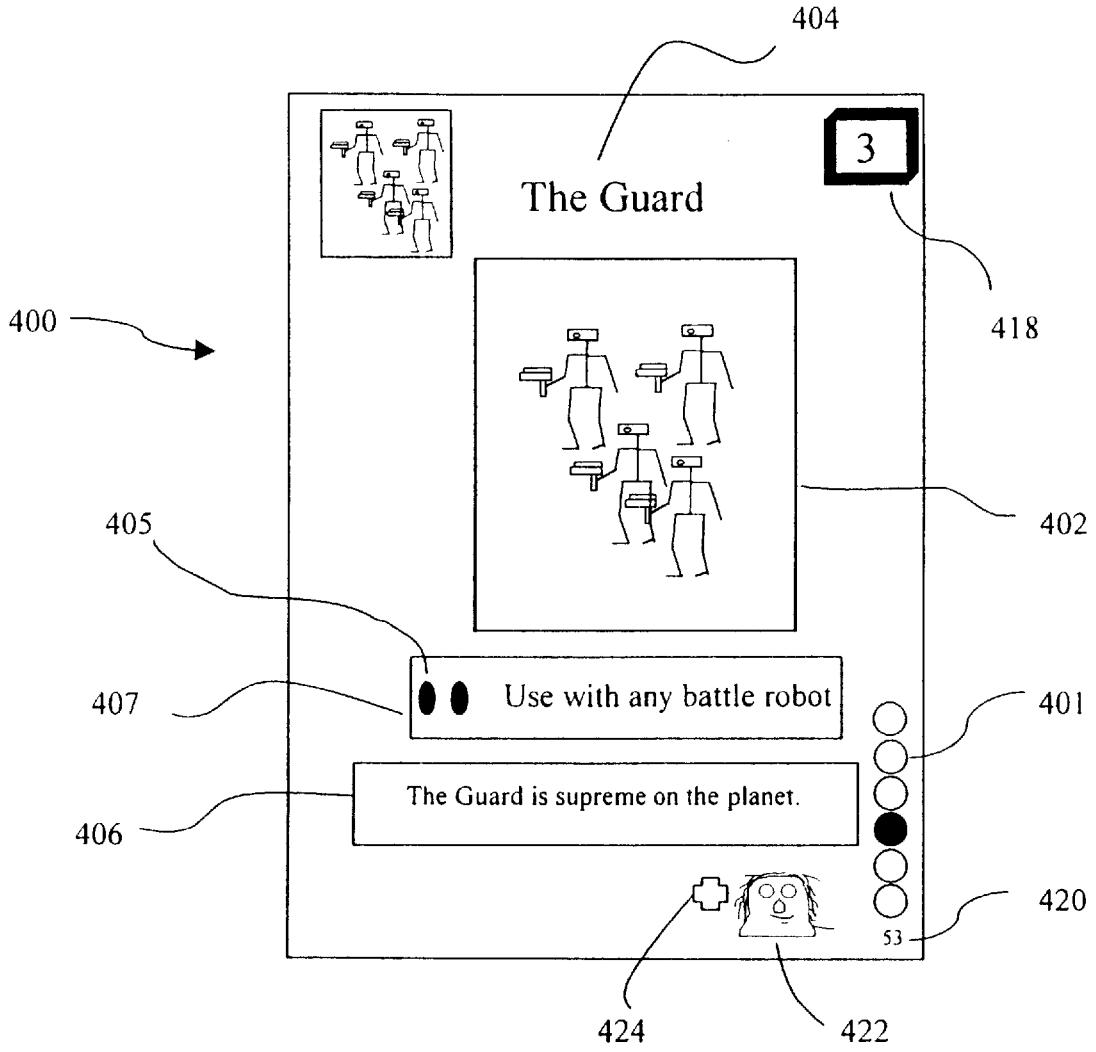
FIG. 6 is a diagram showing a battle card in accordance with an embodiment of the invention.

In accordance with a further embodiment of the invention, battle cards 400, as shown in FIG. 6 may be added to a player's battle plan. As shown in FIG. 6, the battle card 400 includes deck building dots 401, a picture 402, battle group name 404, a description window 406 and chance number 418.

Also, the weapon card 400 includes a restriction window 407. The restriction window 407 dictates what character the battle card 400 may be utilized with. For example, the restriction window 407 as shown in FIG. 4 illustrates that the battle card 400 may be used with any battle robot. Also, similar to the character card 100, the weapon card 400 includes a card number 420, an expansion set icon 422, and a rarity icon 424.

Like weapons, battle cards 400 also insert into a player's battle plan and can help the player defeat their enemies. The difference between a battle card and a weapon card, for example, is that the battle card comes from a player's hand as a surprise. To explain, when a battle is declared, a player looks in their hand to see if the player has any battle cards that that player wishes to use in fights in that battle. Before the player places their hand down on the table, the player takes out the battle cards she wishes to use and places the battle card or cards face down on the table next to the player's characters and weapons. The player does not show the opponent the battle cards they are using, i.e., they are secret, but the player is required to disclose how many battle cards the player is adding to the battle plan.

When a player develops their battle plan, each battle card is placed behind the character card which is desired to be used with that battle card. This is the same as with the weapon cards described above. As a result, in battle, the player will draw a weapon card and/or a battle card until a character card is pulled. Once a character card is pulled, then a fight will follow. The fight will result in a winner based on the power of each character, as described above. In accordance with an embodiment of the invention, a player may only use one battle card in each fight. If a player is using a battle card and a weapon card in the same fight, then the battle card is placed first, then the weapon, then the character.

As noted above, it should be appreciated that there may be limitations placed on the battle cards with respect to which character the battle card may be used with. Illustratively, as shown in FIG. 6, the battle card possesses two power bonus dots 405 to indicate that two (2) is added to the character's power as a result of using the battle card 400. Each battle card is discarded after a player uses it.

It should be appreciated that battle is an optional part of each player and opponent's turn. A player does not have to declare a battle if the player does not wish to. However, if an opponent declares a battle during her turn, then the player must defend himself As described above, in accordance with one embodiment of the invention, the game is played on only one planet. Such a game on one planet may be played with a deck of thirty cards, for example. Alternatively, in another embodiment of the invention which might be characterized as a "full game" the game is played on three planets and the winner is the player who takes two out of the three planets first. In the full game, the first player to go may be determined in any suitable manner. For example, each player may draw destiny, i.e., draw a card and compare the chance number 118, the player who draws the higher chance number 118 gets to go first.

In this embodiment, the player who goes first gains the benefit of choosing which planet and which location to start with. The player may take any location card from that player's deck and put it on the table as the starting location. Both players then shuffle their decks again, including the card which was used as the destiny card. Thereafter, each player draws six cards to make their hands.

In accordance with this further embodiment of the invention, a player must gain control of two planets, rather than one, to win the game. Accordingly, gaining control of a first planet is a major victory. However, the game does not end there. In this embodiment of the full game, the player needs to control two planets for a planet victory. However, a player may still win with a deck victory if the opponents draw deck runs out of cards.

As described above, a planet may be controlled at the end of either player's turn. If a planet is controlled, then it is time to move on to the next planet. To accomplish this, the controlled planet is moved over to the side of the table. The characters and weapons that are still on that planet are moved with it. As a result, that planet is no longer the focus of the game, i.e., a player cannot deploy characters, weapons or locations there, or battle on that planet anymore. Essentially, the characters and weapons remaining there are temporarily "stranded" until a transport ship evacuates them, as described below.

The player who just previously lost the planet then chooses the next planet location. The player must choose a planet that has not been in play previously. For example, if Mars was just controlled, then the player may look to the earth or Saturn location of their choice. To choose, the player first looks for a location card in their discard pile. If the player does not find the location card there, then the player looks through their draw deck. Of course, the player shuffles their draw deck afterwards to avoid any inappropriate advantage. If the player does not find a location card in their draw deck, then the player looks in their hand. When the player has picked the location that player wants, the player puts it face up in the middle of the table. Now that player who chooses the location card takes the first turn at the chosen location. It should be appreciated that it does not matter which player took the turn before, i.e., whenever a player looses a planet, that player always chooses the next planet "and" takes the next turn.

The hidden cards rule was described above. The hidden cards rule applies at each new planet. That is, if a player deploys any characters or weapons on their first turn at that planet, that player must deploy those cards face down as hidden cards. However, as described above, each player turns the cards face up at the start of their second turn and thereafter places all deployed cards face up.

Eventually, the play may further move on to a yet third planet. If a player controls the first two planets, that player wins the game. However, if a player and their opponent each control one planet, the game will proceed to the third and final planet for the tie-breaker. This process works as described above with respect to moving from the first planet to the second planet. Specifically, the player who lost the second planet chooses the starting location for the third planet, and also takes the first turn there. And again, the hidden cards rule will apply to each player's first turn on the third planet.

However, it should be appreciated that the game of the invention is not in any limited to three planets. For example, more planets could be used. However, it may be preferable for the game to include an odd number of planets in order to avoid a tie.

During fighting on a planet, a player may surrender. Specifically, a player may realize that they are losing a planet. That player may make the strategic decision that they do not want to suffer anymore losses on that planet. As a result, that player who is losing the planet can "surrender" that planet at the end of that player's turn. The surrender is announced after the player evens up their hand. If a player surrenders, then the opponent wins control of the planet just as if the opponent had defeated the player's last character on that planet. However, the difference is that any characters and weapons the player has there will also be stranded on that planet when it gets moved to the side of the table.

As described above, the play of the game may result in characters and weapons stranded on a planet. Such stranded characters and weapons cannot battle there. As a result, a player who has stranded characters and weapons will probably want to remove the stranded characters from that planet. Transport ships, for example, may be used in the game to pick up all a player's character and weapon cards at a planet and "evacuate" them from that planet and back to the player's draw deck.

A player may try to evacuate their stranded character and weapon cards only during the deploy step of that player's turn. First, the player plays a transport ship card from their hand to the planet that player wishes to evacuate. Ships have no counters, so this does not go against that player's limit of six counters.

Then, the player takes all their characters and weapons which were stranded on the planet and stacks them under the transport ship. This effectively represents the transport ships picking up the weapon and character card by landing on the planet, or by sending down a shuttle.

However, the opponent has an opportunity to intercept the evacuation. For example, if the opponent has a fighter craft card, for example, in the opponent's hand, the opponent can play it to the table. As a result, a ship battle is initiated.

In this ship battle, the power numbers of the player's transport ship is compared with the power numbers of her opponent's fighter ship. The opponent may get to draw destiny as described above to add to the opponent's fighter craft's power. For example, the player's transport ship does not have this small chance block, so the player does not add a destiny draw to the transport ship's power. It should be appreciated that in accordance with one embodiment of the game, transport ships are large enough to perform evacuations, and only fighter ships are maneuverable enough to draw destiny. In this manner, the game in accordance with the invention simulates real life attributes of the respective ships.

If the opponents star ship has more total power, then the player's transport ship is destroyed. If the player's transport ship is destroyed, then the player discards their transport ship card and all the characters and weapons stacked underneath it. The player must also discard cards from the player's draw deck equal to the transport ship's damage number. However, the damage numbers on the character and weapon cards stacked underneath the transport ship are ignored while the character and weapon cards are being carried aboard a transport.

Alternatively, if the player's transport ship has more power, then the opponent's fighter ship is destroyed. When the opponent's fighter ship is destroyed, that card is discarded and the opponent must also discard cards equal to the damage number on the fighter ship.

Alternatively, the power of the transport ship and the power of the fighter ship plus destiny may be the same. If the power totals are the same, then both ships survive. If the transport ship survives the battle, or if the opponent did not try to intercept the transport ship, then the player's characters and weapons stacked underneath the transport ship have been successfully evacuated. The player then shuffles these character and weapon cards back into the player's draw deck, where the player can draw them again.

Additionally, any fighter ships that did not get destroyed in the battle now "fly away," i.e., the opponent discards them but takes no damage.

It should be appreciated that a player may evacuate their cards from any planet, including even the current planet, if the player desires to try and get the cards back into their draw deck for strategic reasons, for example. However, a player may not use a transport ship where that player has not face-up cards to be evacuated.

It should be appreciated that the above embodiments are merely illustrative and not limiting. Hereinafter, aspects of further embodiments of the game of the invention are described.

In accordance with one embodiment of the invention, the weapon cards may use the chance block 208 as shown in FIG. 2 to add a random amount to a character's power.

However, the power of a weapon card may also be defined by use of a combination power bonus dots, positioned on the weapon, and chance cubes. If a player uses such a weapon, the player may add the power bonus represented by the power bonus dots and then draw destiny. Also, battle cards may use small chance blocks to add power. Essentially, the power bonus dots add a known power to any weapon card, in addition to the variable power added as controlled by the chance cube.

In play of the game in accordance with the invention, a player may make a mistake. For example, a player may inadvertently place two weapons cards in a row in their battle plan. Alternatively, a player may inadvertently try to use a weapon card with a character card, which does not work with that particular weapon card. In this case, the weapon card is ignored, but not discarded, if the weapon card does not come just before a character or does not work with the character.

In accordance with one aspect of the invention, a player may wish to place a battle card in that player's battle plan even if the player recognizes that the battle plan will not work. This is one acceptable way to get rid of a battle card that the player does not currently need. This allows the player at the end of their turn to draw another card. In accordance with one embodiment of the game of the invention, some battle cards include an indication that that battle card allows 2 or 3 characters to "fight together." When a player adds one of these battle cards to that player's battle plan, the player places the battle plan behind the 1, 2 or 3 characters which will fight together, i.e., behind assuming that the cards are facing the player. As a result, the battle card will ultimately be drawn as the battle progresses. The player will then draw additional cards from their battle plan until the number of character cards is drawn as dictated by the battle card.

In accordance with one embodiment, only one weapon card maybe used in any particular fight. That is, for example, while a battle card allows two characters to fight, only one of those characters may use a weapon card. Illustratively, a player may have "one" weapon card after the battle card, if the weapon works with the first character in the group, i.e. in the fight.

To summarize, during the fighting, when a player turns up a battle card, instead of turning up cards until that player gets one character, the player turns up cards until the player gets the group of characters. The characters in that group fight like they were one big character. That is, the player adds all of the character card's power numbers together, including any location bonuses, in addition to adding the power bonuses from the battle card and the weapon card if any. If a player has more total power than their opponent does, then the opponent's character is defeated.

It should be appreciated that a mistake may also be made in this process. For example, suppose a player did not use the right kinds of characters or the right number of characters needed by the battle card. Alternatively, a player may have included more than one weapon or more than one battle card before the characters. If a mistake like this happens in play of the game, the player simply discards the first battle card and places the cards that came after the first battle card back on top of that player's battle plan in the original order. Then the battle plan is continued in accordance with the normal procedure.

Aspects regarding common cards and unique cards, including the stackability of unique cards, will hereinafter be described in further detail. As shown in FIG. 1 and described above, the character card 100 has a mass indicator 117. The mass indicator 117 represents a character that is common. As a result, a player may have as many copies of the character cards 100, which have a mass indicator 117, as is desired. For example, player may have 5 copies of the bargainer shown in FIG. 1. A player may even have different copies of cards which include the mass indicator 117 on different planets. Each copy of the card represents a different individual character or weapon. Accordingly, the weapons may also include the mass indicator 117. However, it should be appreciated that some cards do not have the mass indicator symbol 117.

In accordance with the method of the invention, some cards are "stackable." Cards without the mass indicator symbol represent people and things that there is only one in the universe, as shown in FIG. 5, i.e., unique character card, Naturally, each of these characters and weapons can only be in one place at one time. For example, if there is only one Master Bargainer and that character is stranded on earth, than a further Master Bargainer cannot be deployed to a different planet. This is why transport ships are important in that they might get the Master Bargainer off that planet upon which the Master Bargainer is stranded.

Figure 7:
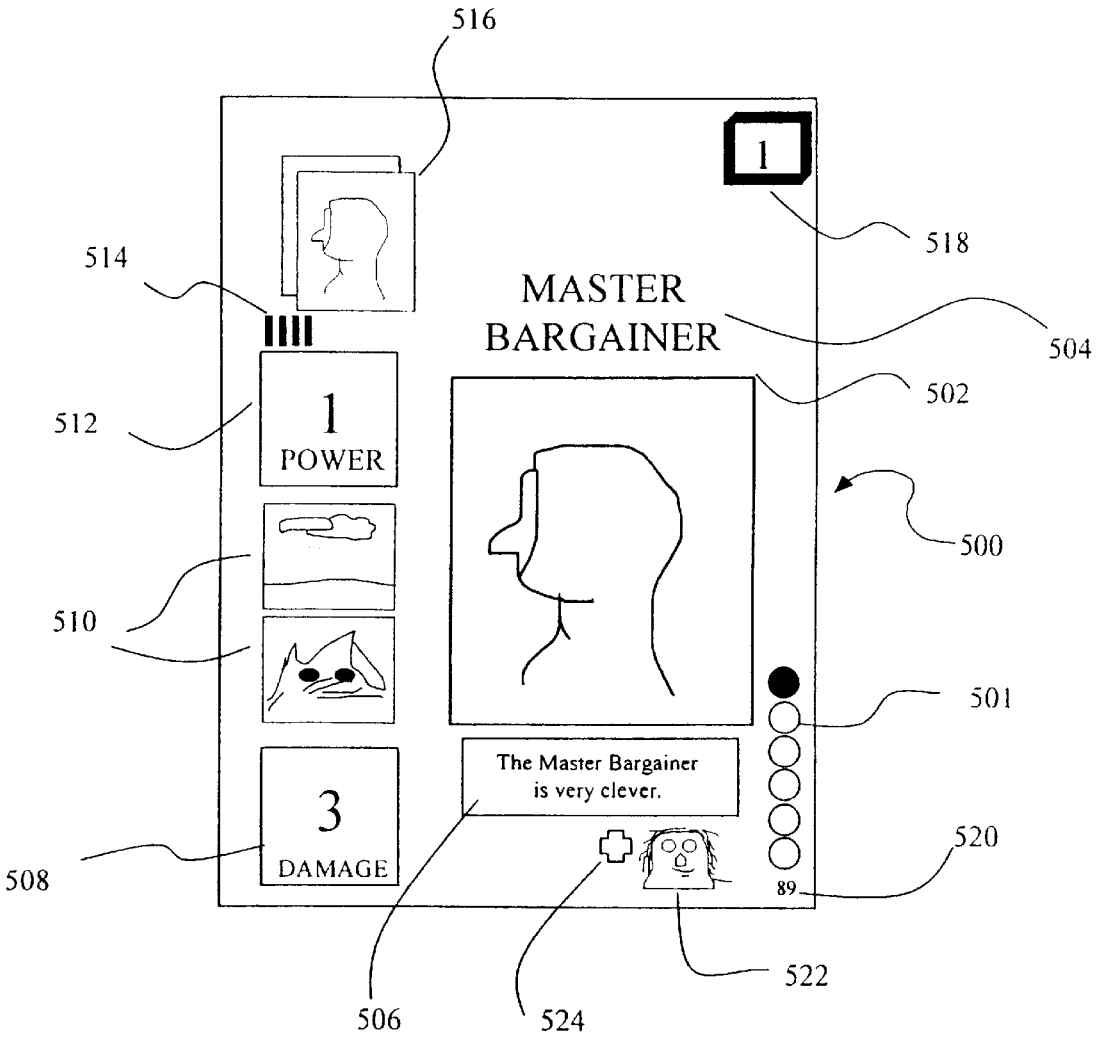
FIG. 7 is a diagram showing a further character card in accordance with an embodiment of the invention.

Even though these characters and weapons are limited to one planet at a time, the stackable feature of the invention provides a way that a player may use extra copies of these cards in play. As shown in FIG. 7, the character card 500 includes a stacking indicator 516. The stacking indicator 516 shows two Master Bargainers stacked upon one another. Accordingly, the stacking indicator 516, which includes stacked icons of the Master Bargainer, indicates that the Master Bargainer is "stackable." This means that a player may build a pile of Master Bargainer cards to make the Master Bargainer stronger in battle. For example, there may be many "bargainers" in the Universe, as shown in FIG. 1. However, there is only one almighty powerful Master Bargainer.

It should be appreciated that the stacking indicator 516 may be used in one of two ways. As shown in FIG. 7, there are two Master Bargainers stacked upon one another. This depiction may be used to generally indicate that the Master Bargainer card 516 is stackable and that as many Master Bargainers may be used, in a fight for example, as is available and desirable, subject to any other applicable rules of the game.

However, the two Master Bargainers stacked upon one another may indicate specifically that no more than "two" Master Bargainers may be used in a particular fight. That is, the number of stacked icons 516, in FIG. 7 there are two, actually dictate how many Master Bargainer cards may be used in a fight. Illustratively, there are four stacking indicators 516, then four Master Bargainers may be used in a particular fight.

In accordance with one embodiment of the invention, some unique cards of a particular character may display the stacking indicator 516 indicating stackability, while other unique cards of that same character do not. In accordance with one manner of play, if a player has at least one character, which possesses the stacking indicator 516 indicating stackability, then all cards of that one character may be stacked in a particular fight.

When a player possesses a Master Bargainer card in play at the current planet and a second Master Bargainer card in that player's hand, the player may deploy the second Master Bargainer to the same stack. It should be noted that each card costs its normal number of counters.

As a result, two Master Bargainers are disposed in this stack. In accordance with the play of the invention, this deployment does not mean that there are two Master Bargainers in the universe. Instead, the deployment means that the Master Bargainer can now fight twice in each battle because the Master Bargainer will come up twice in the battle plan.

For example, the first Master Bargainer may come up in the battle plan and defeat an opposing character. Then, the second Master Bargainer card takes on the next challenger. This represents how a character in a movie takes on several opponents during the same battle. He swings his sword at a first character, then immediately moves to fight another character all in a blur. Stackable characters allow a player to simulate this real life aspect of the fight.

When a player develops a battle plan, the player may put the character cards in any order that player desires. In other words, the Master Bargainer does not necessarily have to make all of the Master Bargainer strikes in a row. Alternatively, the Master Bargainer can strike, then let other characters fight, then the Master Bargainer may fight again.

It should be appreciated, the Master Bargainer may lose. If a Master Bargainer loses one of his fights, that character card is discarded as usual, and damage is taken to the losing player's draw deck. Then battle is continued as normal. That is, the second Master Bargainer in that player's battle plan is not discarded unless that Master Bargainer also loses the subsequent fights. This might be characterized as the Master Bargainer lost one or more of his fights in this battle, and as a result, he will not be able to strike as many times in the next battle. Finally, when the last card in your battle plan i.e. in the stack containing the Master Bargainer cards, is defeated, then the Master Bargainer has been driven from the planet. As a result, the player may deploy more Master Bargainer cards if that player desires.

It should be appreciated that each of the stackable characters of the same type, i.e. all the Master Bargainer cards, do not possess the same attributes in accordance with one embodiment of the invention. For example, each version of a particular character card may have different location bonus, giving each card its own special strength depending on where the current battle is waged. The different battles allow a player to fine-tune their decks so as to have bonuses the player desires for the locations where that player plans to fight.

As described above and in accordance with one embodiment of the invention as described herein, the collectible card game of the invention provides a systematic and controlled manner by which a player may reduce potentially hundreds of cards to a deck of predetermined size. The player's deck possesses a predetermined number of cards from each class. For example, starter decks may be packaged and sold. These starter decks have the appropriate number of cards for each class so that a player may start playing the game right out of the box. In addition, additional cards may be sold and purchased in any suitable manner. For example, the cards may be sold in booster sets. The cards may be collected, played and traded.

In accordance with one embodiment of one of the collectible card game of the invention, each player's deck may include 60 cards. Accordingly, a person may expand their collection with starter decks, booster packs or collector's boxes. The particular cards contained in any one of these may be randomly varied. As a result, it may be desirable for a person to trade with friends for the cards that that person does not have.

A person chooses cards from their entire collection of potentially hundreds of cards to generate their deck of 60 cards. The player must follow two rules in creating their deck. In accordance with one embodiment of the invention these two rules are (1) the 6-x-10 rule; and (2) the 3-planet rule.

The 6-x-10rule is used to control the composition of a player's deck as described above. Each card has a deck building dot 101 in the lower right corner of the card as shown in FIG. 1, for example. Illustratively, there are 6 different colors including red, orange, blue, yellow, green and purple. When a player builds their deck, the player must have exactly 10 cards for each deck-building dot color. That is, the player must have 10 red-dot cards, 10 orange-dot cards and so forth. As described above, the colors correspond to the location of the filled deck building dot 101. That is, a player may discern which class a card belongs to by either (1) the color of the deck building dot, or alternatively, (2) the location of the colored dot.

However, it should be appreciated that the cards in accordance with the invention do not necessarily have to include a symbol 101 or other indicia to indicate the class of the card. Alternatively, a list of classes may be provided.

That is, the list of classes may provide information regarding the class that each of the cards is assigned. Accordingly, a card player looking at a particular card alone would not be able to ascertain which class that the particular card belonged. However, the list of classes would provide a key or legend, for example, such that the card player could determine the class of a particular card.

In accordance with an embodiment of the collectible card game of the invention, the cards may be sold in starter decks. Each starter deck may have 5 cards for each dot color, i.e. for each class. As a result, each player will play with a 30-card deck. Accordingly, the collectible card game of the invention may be played with a 30 card deck, a 60 card deck, or some other agreed upon number.

The 3-planet rule dictates that a player must have at least one location card for each of the three planets. For example, all the location cards may belong to the class represented by the purple dot, which is always located at the forth down deck building. 101. Accordingly, when a player chooses their 10 purple-dot cards, that player must have at least three location cards if there are three locations.

It should be appreciated that a player may make another type of mistake in the game. For example, a player may ultimately determine in play of the game that the player has an illegal 11 cards of one class and 9 cards of another class. If a mistake of this nature is discovered during a play that a player's deck is not legal, then that player loses the game.

It should be appreciated that the cards in accordance with the collectible card game of the invention may be used as collector items. Each card is designed to help a person keep track of their collection. As described above, each card includes a card number 120, an expansion set icon at 122 and a rarity icon 124. The expansion set icon 122 indicates which expansion set the card originally belonged to. The cards may be numbered in any suitable manner to assist in a determination of whether a person has an entire set, for example.

As shown in FIG. 1, the cards also include a rarity icon 124. Each card's rarity may be indicated by an appropriate symbol and corresponding legend. For example, the rarity icon 124 as shown in FIG. 1 may illustrate that the card is common.

Further, sale of the collectible cards of the invention may be promoted using specialty cards. For example, defraction foil insert cards, which add to the animation of the character, may be randomly inserted in the booster packs, for example.

Figure 8:
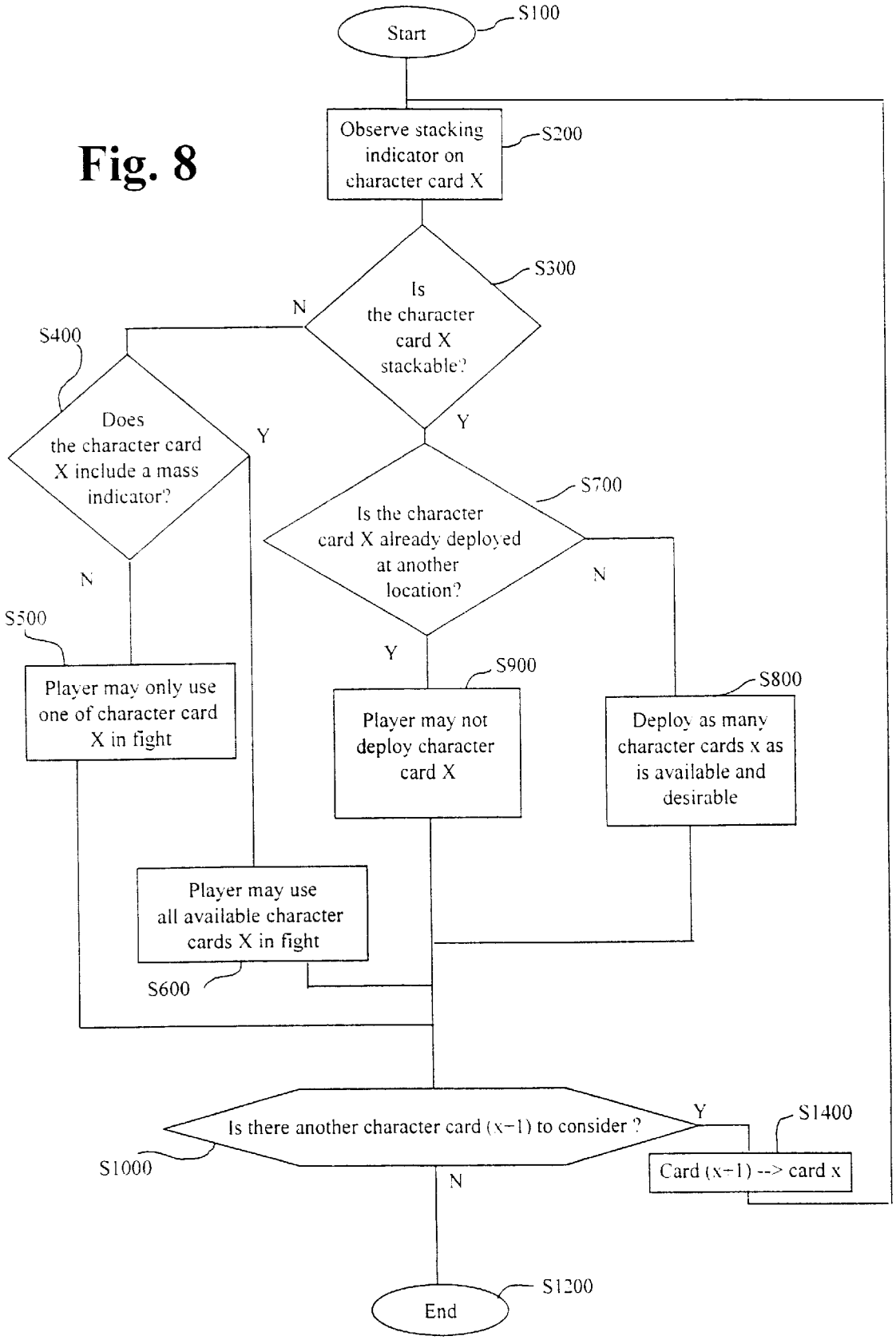
FIG. 8 is a flow chart showing the card game method in accordance with an embodiment of the invention.

To further explain the stacking feature of the character cards as described herein, FIG. 8 is a flowchart showing the process in accordance with the method of the invention. As shown in FIG. 8, the process starts in step S100. Then the process passes to step S200. In step S200, the card player observes the stacking indicator on a character card X. Then, the process passes to step S300. In step S300, the player determines whether character card X is stackable. If no, then the process passes to step S400.

In step S400, the player determines whether the character card X includes a mass indicator. If the character card X does not include a mass indicator, then the process passes to step S500. In step S500, the player may only use one of the character card X in a fight.

Alternatively, in step S400, the character card X may include a mass indicator. Then, the process passes to step S600. In step S600, the player may use all available character card X without limitation on the number of character cards X used, subject to any other applicable rules of the game.

However, in step S300, the user may determine that character card X is stackable. Then the process passes to step S700. In step S700, the user determines whether the character card X is already deployed at another location. If yes, then in step S900, the player may not deploy the character card X in the current fight, since the character card X is deployed at another location.

Alternatively, if in step S700 the user determines that the character card X is not already deployed at another location, then the process passes to step S800. In step S800, the player may deploy as many of the character cards X as available and desirable. It should be appreciated that the character cards X which are available will depend on the particular rules of the card game. In the illustrative embodiment described above, the available character cards X are chosen from those cards in a player's "battle group."

Subsequent to either step S500, step S600, step S900, or step S800, the process passes to step S1000. In step S1000, the player determines whether there is another card (X+1) to consider.

If yes, the process passes to step S1400. In step S1400, the collectible card (X+1) is assigned as "card X." After step S1400, the process returns to step S200 for a further iteration of the process of the invention.

Alternatively, if there is not another card (X+1) to consider in the player's cards in step S1000, then the process passes to step S1200. In step S1200, the process ends.

As described above, the method of the invention is implemented in the form of hand-held cards. However, it should be appreciated that the scope of the invention is not limited to hand-held cards. Rather, the method of the invention may be utilized in conjunction with a computer or other operating system.

Figure 9:
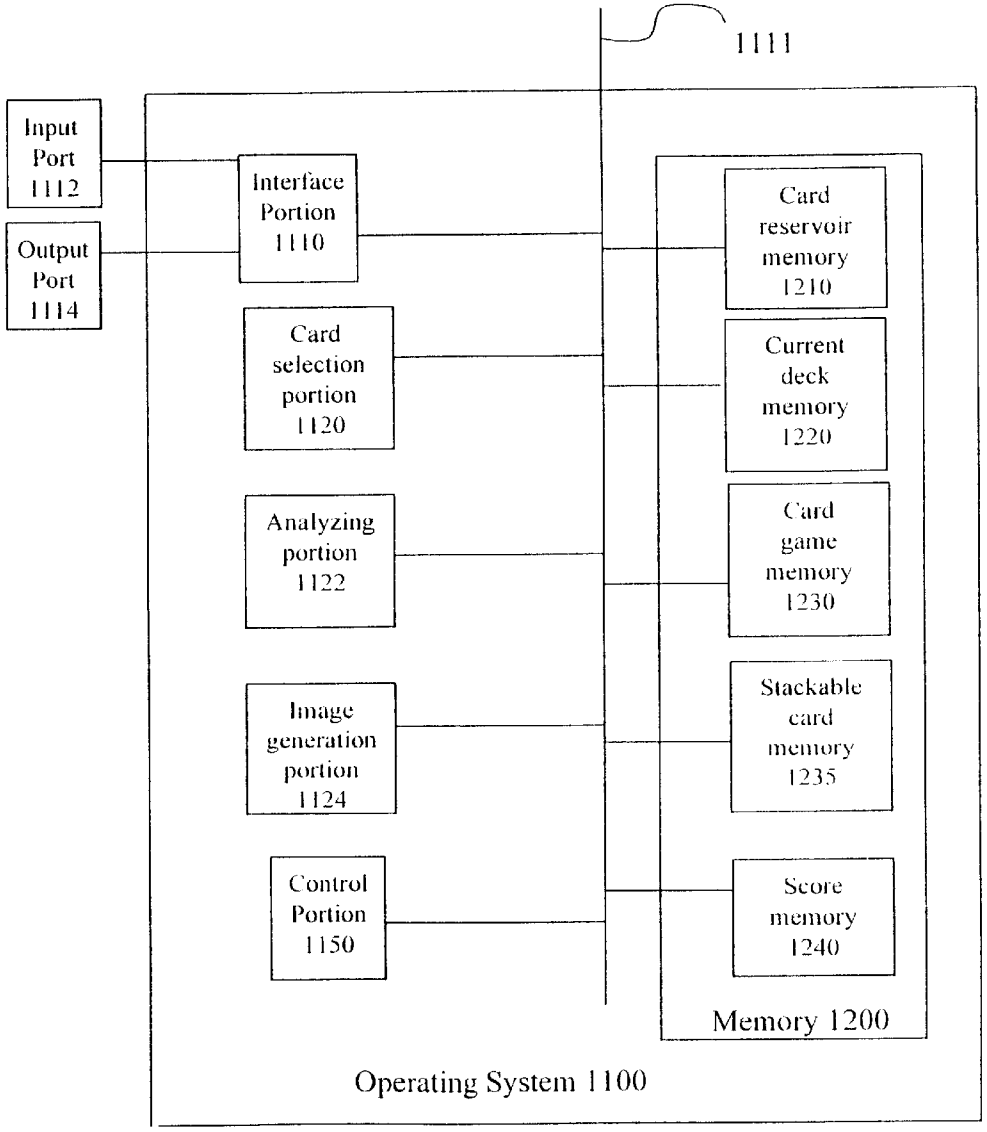
FIG. 9 is a diagram showing an operating system to play a card game in accordance with an embodiment of the invention.

FIG. 9 shows an illustrative operating system 1100 by which the method of the invention may be implemented in accordance with one embodiment using virtual collectible cards, i.e., cards electronically represented. Specifically, FIG. 9 is a block diagram showing an embodiment of an operating system 1100 in accordance with the invention. The operating system 1100 processes input data and generates output in response to such input data. The operating system 1100 includes an interface portion 1110 and a control portion 1150. The operating system 1100 receives and outputs data using the interface portion 1110. The interface portion 1110 includes both an input port 1112 and an output port 1114 for receiving and sending image data, respectively. The control portion 1150 controls the operation of the various components and portions in the operating system 1100. Each of the components of the 1100 is connected by an interface 1111.

Additionally, the operating system 1100 includes a card selection portion 1120, an analyzing portion 1122, an image generation portion 1124, and a memory 1200. The memory 1200 includes a card reservoir memory 1210, a current deck memory 1220, a card game memory 1230, a stackable card memory 1235, and a score memory 1240.

The card reservoir memory 1210 is used by the control portion 1150 to store collected card data. Thus, the card reservoir memory 1210 is the equivalent to a personal collection of hand-held cards. The current deck memory 1220 stores data representing a deck of cards selected from the card reservoir memory 1210. The card game memory 1230 contains operating parameters of the card game, including the rules, such as those rules described above in accordance with one embodiment of the invention.

The memory 200 also includes the stackable card memory 1235. The stackable card memory 1235 stores data regarding which cards, in the "virtual" deck displayed by the operating system 100, are stackable. In accordance with an embodiment of the invention, the stackable card memory 1235 also stores data regarding which cards are unique and which cards are common.

Illustratively, the memory 1200 may also include a score memory 1240. The score memory 1240 stores various scoring parameters in a card game using the method of the invention.

In accordance with an embodiment of the invention, the player first selects cards from the card reservoir memory 1210 by exerting requested input as controlled by the card selection portion 1120. That is, the card selection portion 1120 generates prompts by which a user forms a playing deck. The card selection portion 1120 provides a process for a player to choose cards, for that player's "playing deck" stored in the card reservoir memory 1210 from potentially hundreds of collected cards. According to the invention, each collectible card in the card reservoir memory 1210 is assigned to a particular class. The composition of the playing deck is controlled in that the playing deck may only include so many cards from each particular class. This playing deck is then stored in the current deck memory 1220. Once the current deck memory 1220 possesses a complete playing deck, the user may initiate the card game.

During play of the virtual card game, the analyzing portion 1122 inputs data, e.g., keystrokes or the movement of a mouse, and generates appropriate output using the card game memory 1230. Specifically, in accordance with an illustrative embodiment of the invention, the analyzing portion 1122 controls the image generating portion 1124 to generate appropriate images, output through the output port 1114, to simulate play of a card game.

The analyzing portion 1122 uses the stackable card memory 1235 to determine whether a card in play is a common card or a unique card. The analyzing portion 1122 also uses the stackable card memory 1235 to determine whether a card in play is a unique card that is stackable.

As described above, one embodiment of the system of the invention as shown in FIG. 9 is in the form of a computer system. As used herein, the term "computer system" is to be understood to include at least a processor operating with a memory. The memory stores at least portions of an executable program code at one time or another. Additionally, the processor executes one or more of the instructions included in that executable program code. As used herein, it will be appreciated that the term "executable program code" and term "software" mean substantially the same thing for the purposes of description as used herein.

Further, it is to be appreciated that to practice the system and method of the invention, it is not necessary that the processor and/or the memory be physically located in the same place. That is, it should be appreciated that each of the processor and the memory may be located in geographically distinct locations and connected so as to communicate in a suitable manner. Additionally, it should be appreciated that the processor and/or the memory may be different physical pieces of equipment. Accordingly, it is not necessary that the processor be one piece of equipment in one location and that the memory be another single piece of equipment in another location. That is, it is contemplated that the processor may be two pieces of equipment in two different physical locations. The two pieces of equipment may be connected in any suitable manner. Additionally, the memory may include two or more pieces of memory in two or more physical locations. Further, the memory could include or utilize memory stores from the Internet, Intranet, Extranet LAN or some other source as may be necessary or desired.

As described above, the invention may illustratively be embodied in the form of a computer program or computer operating system. It is to be appreciated that the software that enables the computer operating system to perform the operations described above may be supplied on any of a wide variety of media. Further, it should be appreciated that the implementation and operation of the invention may be in the form of code written in any suitable programming language.

It should be appreciated that the software code or programming language that is utilized in a computer system to perform the above described invention may be provided in any of a wide variety of forms. Illustratively, the software may be provided in the form of machine language, assembly code, object code, or an original source code, as well as other forms of media. Further, the software may be in the form of compressed or encrypted data, for example, of the foregoing types of media.

Additionally, it should be appreciated that the particular medium utilized may take on any of a variety of physical forms. Illustratively, the medium may be in the form of a compact disk, an integrated circuit, a hard diskette, a floppy diskette, a tape, a RAM, a ROM, a remote transmission using a type of communication circuit, as well as any other medium or source of information that may be read by a computer or other operating system.

Accordingly, the software of the method of the invention may be provided in the form of a floppy disk or be transmitted in some form using a direct telephone connection, the Internet, the Intranet, or a satellite transmission, for example. Further, the programming language enabling the method of the invention as described above may be utilized on all of the foregoing and any other medium by which software or executable program language may be communicated to and utilized by a computer or other operating system.

As described herein, the system and method of the invention may utilize an application program, a set of separate application programs, a module of a program, or a portion of a module of a program, for example. As noted above, it should be appreciated that the computer readable language used in the system and method of the invention may be any of a wide variety of programming languages. Further, it is not necessary that a single programming language be utilized in conjunction with operation of the system and method of the invention. Rather, any number of different programming languages may be utilized as is necessary or desirable.

As described above, in the system and method of the invention, a variety of user interfaces are utilized. A user interface may be in the form of a dialogue screen as illustrated herein. As used herein, a user interface includes any software, hardware or combination of hardware and software used by a computer system or other operating system that allows a user to interact with the operating system. A user interface may include any of a touchscreen, keyboard, mouse, voice reader, voice recognizer, dialogue screen, a menu box, a list, a checkbox, a toggle switch, a pushbutton or any other object that allows a user to receive information regarding the operation of the program and/or provide the operating system with information. The information provided by the user may be in the form of a command, selection or data, for example.

A user interface is utilized by an operating system in the process of running an application program. As should be appreciated, a user interface is typically used for interacting with a user either to convey information or receive information. However, it should be appreciated that in accordance with the system and method of the invention, it is not necessary that a human user actually interact with the user interface generated by the operating system. Rather, it is contemplated that the user interface of the invention interact, i.e., convey and receive information, in communication with another operating system or program, rather than a humane user. Illustratively, the other operating system may simulate in whole or in part, the actions of a human user. Further, it is contemplated that the user interfaces utilized in the invention may interact partially with another operating system while also interacting partially with a human user.

It will therefore be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the invention in the foregoing description thereof, without departing from the substance or scope of the present invention.

Accordingly, while the present invention has been described herein in detail in relation to its exemplary embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise exclude any such other embodiments, adaptations, variations, modifications and equivalent arrangements, the present invention being limited only by the claims.

What is claimed is:

1. A card game comprising two decks of cards each deck includes a defined number of cards from a defined number of classes, each card in each deck includes a class identifier and a numeric value, each card in each deck is selected from the group consisting of character cards, weapon cards, location cards, and battle cards, each character card comprises one of a plurality of character identifiers, a power identifier which is variable, a damage identifier, ranking indicia, and a stackability indicator, each weapon card comprises an identifier which identifies at least one of said plurality of character identifiers and a stackability indicator, each location card identifies a specific location, and each battle card comprises indicia identifying at least one of said plurality of character identifiers.

2. The card game of claim 1 wherein said defined number of classes in each deck is six.

3. The card game of claim 2 wherein said defined number of cards is selected from the group consisting of five and ten.

4. The card game of claim 1 wherein each card further comprises a collectability indicator.

5. The card game of claim 1 wherein the character identifier of each character card includes a name and a picture.

6. The card game of claim 1 wherein each power identifier of said character cards identifies a value associated with each location, said value being added to said power identifier.

7. The card game of claim 6 wherein said value is zero or a positive number.

8. The card game of claim 1 wherein each battle card includes a specific power factor for at least one of said plurality of character identifiers.

9. The card game of claim 1 wherein the stackability indicator signifies a number greater than one of identical character cards which are stackable.

10. A method for playing a card game, comprising the steps of:

supplying each of two players with a deck of cards, said deck of cards including a defined number of cards from a defined number of classes, each card in each deck including a class identifier and a numeric value, each card in each deck selected from the group consisting of character cards, weapon cards, location cards, and battle cards, each character card comprising one of a plurality of character identifiers, a power identifier which is variable, a damage identifier, ranking indicia, and a stackability indicator, each weapon card comprising an identifier which identifies at least one of said plurality of character identifiers and a stackability indicator, each location card identifying a specific location, and each battle card comprising indicia identifying at least one of said plurality of character identifiers;

each player obtaining a defined number of cards from said deck of cards supplied in said supplying step and choosing a strategy of play for said defined number of cards;

comparing one or more groups of cards for each player; and discarding cards based upon a comparison obtained from said comparing step.

11. The method of claim 10 further comprising the step of stacking character cards where the stackability indicator signifies the characters are stackable with identical character cards and wherein said step of stacking increases the power of said stackable character cards.

12. A computerized system for a virtual card game comprising a computer system, further comprising at least a processor, memory, at least one output device capable of generating images, and at least one input device and a computer program capable of displaying and controlling the status of the virtual card game comprising two virtual decks of virtual cards, each virtual deck includes a defined number of virtual cards from a defined number of classes, each virtual card in each virtual deck includes a class identifier and a numeric value, each virtual card in each virtual deck is selected from the group consisting of virtual character cards, virtual weapon cards, virtual location cards, and virtual battle cards, each virtual character card comprises one of a plurality of character identifiers, a power identifier which is variable, a damage identifier, ranking indicia, and a stackability indicator, each virtual weapon card comprises an identifier which identifies at least one of said plurality of character identifiers and a stackability indicator, each virtual location card identifies a specific location, and each virtual battle card comprises indicia identifying at least one of said plurality of character identifiers.

13. The computerized system for the virtual card game of claim 12 wherein said defined number of classes in each virtual deck is six.

14. The computerized system for the virtual card game of claim 13 wherein said defined number of virtual cards is selected from the group consisting of five and ten.

15. The computerized system for the virtual card game of claim 12 wherein each virtual card further comprises a collectability indicator.

16. The computerized system for the virtual card game of claim 12 wherein the character identifier of each virtual character card includes a name and a picture.

17. The computerized system for the virtual card game of claim 12 wherein each power identifier of said virtual character cards identifies a value associated with each location, said value being added to said power identifier.

18. The computerized system for the virtual card game of claim 17 wherein said value is zero or a positive number.

19. The computerized system for the virtual card game of claim 12 wherein each virtual battle card includes a specific power factor for at least one of said plurality of character identifiers.

20. The computerized system for the virtual card game of claim 12 wherein the stackability indicator signifies a number greater than one of identical character cards which are stackable.

21. A method for playing a computerized virtual card game on a computer system, said computer system further comprising at least a processor, memory, at least one output device capable of generating images, and at least one input device, and a computer program capable of the following steps:

supplying each of two players with a virtual deck of virtual cards, said virtual deck of virtual cards including a defined number of virtual cards from a defined number of classes, each virtual card in each virtual deck including a class identifier and a numeric value, each virtual card in each virtual deck being selected from the group consisting of virtual character cards, virtual weapon cards, virtual location cards, and virtual battle cards, each virtual character card comprising one of a plurality of character identifiers, a power identifier which is variable, a damage identifier, ranking indicia, and a stackability indicator, each virtual weapon card comprising an identifier for identifying at least one of said plurality of character identifiers and a stackability indicator, each virtual location card identifying a specific location, and each virtual battle card comprising indicia identifying at least one of said plurality of character identifiers;

each player obtaining a defined number of virtual cards from said virtual deck of virtual cards supplied in said supplying step and choosing a strategy of play for said defined number of virtual cards;

comparing one or more groups of virtual cards for each player; and discarding virtual cards based upon a comparison obtained from said comparing step.

22. The method of claim 21 further comprising the step of stacking characters cards where the stackability indicator signifies the characters are stackable with identical character cards and wherein said step of stacking increases the power of said stackable character cards.

* * * * *